US012127631B2

(12) United States Patent
Reichard

(10) Patent No.: US 12,127,631 B2
(45) Date of Patent: Oct. 29, 2024

(54) SANDAL HAVING DETACHABLE STRAP FASTENING

(71) Applicant: Benno Reichard, Zurich (CH)

(72) Inventor: Benno Reichard, Zurich (CH)

( * ) Notice: Subject to any disclaimer, the term of this patent is extended or adjusted under 35 U.S.C. 154(b) by 59 days.

(21) Appl. No.: 17/884,670

(22) Filed: Aug. 10, 2022

(65) Prior Publication Data

US 2022/0378143 A1 Dec. 1, 2022

Related U.S. Application Data

(63) Continuation-in-part of application No. 16/966,464, filed as application No. PCT/DE2019/100147 on Feb. 15, 2019, now abandoned.

(51) Int. Cl.

| | |
|---|---|
| ***A43B 3/10*** | (2006.01) |
| ***A43B 3/12*** | (2006.01) |
| ***A43B 3/24*** | (2006.01) |

(52) U.S. Cl.

CPC ..... *A43B 3/122* (2013.01); *A43B 3/102* (2013.01); *A43B 3/244* (2013.01)

(58) Field of Classification Search

CPC ..... A43B 3/10; A43B 3/102; A43B 3/103; A43B 3/105; A43B 3/108; A43B 3/12; A43B 3/122; A43B 3/128; A43B 3/242; A43B 3/244; A43B 3/246

See application file for complete search history.

(56) References Cited

U.S. PATENT DOCUMENTS

| | | | | | |
|---|---|---|---|---|---|
| 2,526,940 | A * | 10/1950 | Fello | A43B 3/122 36/11.5 |
| 3,978,596 | A * | 9/1976 | Brown | A43B 3/122 36/11.5 |
| 4,300,294 | A * | 11/1981 | Riecken | A43B 3/24 36/97 |
| 2002/0100189 | A1 | 8/2002 | Manzi | |
| 2005/0183219 | A1 | 8/2005 | Saladino | |

(Continued)

FOREIGN PATENT DOCUMENTS

| | | | |
|---|---|---|---|
| DE | 19839356 | A1 | 3/2000 |
| DE | 202015008872 | U1 | 1/2016 |
| WO | 2006060038 | A2 | 6/2006 |

OTHER PUBLICATIONS

Office Action for the base U.S. Appl. No. 16/966,464, notification date: Feb. 11, 2022.

*Primary Examiner* — Ted Kavanaugh
(74) *Attorney, Agent, or Firm* — Michael Soderman

(57) ABSTRACT

A sandal having a detachable strap fastening, comprising a sole, at least one strap and at least one cam buckle and/or at least one anchor buckle. The sandal is modularly constructed and can be easily assembled and disassembled. The sole and the at least one strap are connected to each other by guiding the at least one strap through apertures provided in the sole. The two ends of the at least one strap are either fastened to the strap again by means of at least one of the cam buckles so as to form a loop or are anchored to one of the apertures by means of at least one of the anchor buckles, wherein the fastening of at least one cam buckle and/or the at least one anchor buckle is effective by friction-locking and they can be opened manually after closing and can be detached from the strap.

14 Claims, 3 Drawing Sheets

(56) References Cited

U.S. PATENT DOCUMENTS

| | | | | |
|---|---|---|---|---|
| 2006/0026861 | A1* | 2/2006 | Manzi | A43B 3/122<br>36/11.5 |
| 2008/0168682 | A1* | 7/2008 | Le | A43B 3/103<br>36/11.5 |
| 2010/0223812 | A1* | 9/2010 | Batanero Bastida | A43B 13/12<br>36/11.5 |
| 2014/0230286 | A1* | 8/2014 | Paugh | A43B 1/0063<br>36/25 R |
| 2015/0237950 | A1* | 8/2015 | Caldwell | A43B 3/126<br>36/100 |
| 2019/0116925 | A1* | 4/2019 | Darby | A43B 7/1405 |
| 2020/0229534 | A1 | 7/2020 | Moretti | |

* cited by examiner

SANDAL HAVING DETACHABLE STRAP FASTENING

CROSS REFERENCE TO RELATED APPLICATIONS

This application is a continuation-in-part of U.S. Ser. No. 16/966,464, filed on 2020 Jul. 31, which is the U.S. national stage of International Application No. PCT/DE2019/100147, filed on 2019 Feb. 2015. The international application claims the priority of DE 202018100824.2 filed on 2018 Feb. 2015; all applications are incorporated by reference herein in their entirety.

BACKGROUND

The invention relates to a technical solution to build a fully modular sandal with detachable straps, detachable soles, detachable strap fastenings (buckles) and a kit for the sandal. Sandals have the decisive advantage over closed shoes that they give the wearer an open and liberating feeling at the feet and allow good ventilation of the feet. They are mainly worn at air temperatures above 20° C. (degrees Celsius). According to conventional construction, they consist of a sole and at least one strap on the left and equally on the right side. The sole covers and protects the foot sole and the strap runs at least over the instep of the foot to keep the foot connected to the sole. The strap and the sole are inseparable from each other in most cases. In the widely used design with a multi-layered sole, the ends of the straps are glued between two of the layers.

It is a general problem for shoes and sandals, that even if they often consist of recyclable materials, the mix of interconnected materials makes it very complex and inefficient to recycle them. To create a construction which allows low-complex recycling and avoids the sandals and the valuable raw material directly going to the trash after their end of use, it seems necessary to provide modular solutions which support a circular economy.

Modular and detachable systems and corresponding protected inventions (patents, utility models) as prior art already propose connecting the upper part of the sandals to the sole by using apertures integrated in the sole. In prior art, if the straps are designed from a flat textile or leather strip, in most cases the strap ends are inserted through the apertures and a fastening device, like for example, a tension-lock-buckle, or a hook-and-loop fastening, or an anchor device is attached by means of a textile seam, gluing, welding, or alternatively a riveted additional element is added. Connections designed in this way no longer allow the sandal to be completely disassembled into all its single components in an easy manner or without destruction.

The patent application US 2014/0 230 286 A1 already formulates an invention for reasons of ecological sustainability such as biodegradability of the shoe sole. It proposes a detachable shoe upper, so the sole made of biodegradable resins can be composted after its end-of-use. According to the cited patent application, a "shoe sole" and a "shoe upper" are joined together by nonspecific means which are listed in claim 5, but not technically described further. However, it is not a mandatory and decisive element of the invention to allow non-destructive separation from the individual components of the fastening element, i.e. such as the strap and the buckle, as you can also see in FIGS. 3A and 3B of the cited prior art patent application where a connecting seam between upper and sole is shown. Also FIG. 1A of the cited patent application shows the use of a hook-and-loop fastening, which will not be detachable from the straps non-destructively. So the listed fastening options are rather joining principles than technical solutions. The term buckle which is used in claim 5 is nonspecific, since there exist many different types of buckles with different operating principles, and the cited patent application doesn't provide a technical solution, since it doesn't describe how the attachment to the buckle works and how the buckle operates. It is not part of the cited document, that the fastening element is detachable from the upper.

Further the patent application US 2008/0 168 682 A1 already formulates a modular sandal invention for reasons of facilitating different use configurations. It proposes a completely detachable multi-positional strap and a sole with apertures to connect the strap to. According to the cited patent application, the strap and sole are joined together by nonspecific fasteners. The invention is rather focusing on the adjustable arrangements and not the technical solution. The term buckle which is used in paragraph [0018] is nonspecific, since there exist many different types of buckles with different operating principles as described above. The invention does not provide a technical solution for the fastening itself, since it does not describe how the attachment to the buckle works and how the buckle operates. It is not part of the cited document, that the fastening element is detachable from the upper.

Also the patent application US 2015/0 237 950 A1 already formulates a convincing modular sandal invention for reasons of user-configuration. It proposes a completely detachable shoe upper, and a base member (sole) with several anchor points (eyelets or apertures), which allows various strap arrangements and embodiments. According to the cited patent application, the technical solution to attach the straps to the sole is based on a specific strap construction, "having a plurality of strap apertures along a length the straps and a fastener to be disposed through two strap apertures to couple each of the one or more straps to itself and around at least a portion of an anchor point". The invention also uses apertures in the sole and straps forming a loop being guided through these holes, but the proposed technical and operational solution is based on a form-fit connection of the fastener inserted in the strap apertures.

Also utility model DE20-2015/008872U1 already formulates an invention, which is aimed at closed shoes and proposes, among other things, a completely detachable shoe upper construction. According to the cited prior art utility model, a "shoe sole element" and a "shoe upper element" are joined together by means of a "connecting element" in such a way that the components can be separated again. However, it is not a mandatory and decisive element of the invention to allow non-destructive separation from the individual components of the "connecting element", i.e. such as the strap and the buckle. The cited document does not provide a technical solution for the fastening itself, since it does not describe how the buckle is connected to the strap.

As a conclusion, only the document US 2015/0 237 950 A1 presents a technical solution for the fastening, offering a way to connect and completely separate all single components dispensing on seams, welding, gluing or other connections that cannot be separated without destruction. In general, a hook-and-loop fastening is not separable without destruction, since it is usually connected to the straps by stitching, gluing or welding.

SUMMARY

The invention relates to a sandal having detachable strap fastening, comprising a sole (1), at least one strap (2) and at least one cam buckle (4) and/or at least one anchor buckle (3). According to the invention, the sandal is modularly constructed and can be easily assembled and disassembled. The sole (1) and the at least one strap (2) are connected to each other by guiding the at least one strap (2) through apertures (5) provided in the sole (1). The two ends of the at least one strap (2) are either fastened to the strap (2) again by means of at least one of the cam buckles (4) so as to form a loop or are anchored to one of the apertures (5) by means of at least one of the anchor buckles (3), wherein the fastening of at least one cam buckle (4) and/or the at least one anchor buckle (3) is effective by friction-locking and they can be opened manually after closing and is detachable from the strap (2).

DETAILED DESCRIPTION

The following glossary is to make clear the meaning of the terms as used in the present patent application:

- "clamping buckle"—specific buckle type to be attached to all kinds of straps by the mechanical principle of friction locking which is realized by a clamping lever
- "anchor buckle"—a detachable basic clamping buckle which is affixed to a strap end so it can't slip through the aperture,
- "cam buckle"—a detachable clamping buckle which is used to affix a strap end to the strap again after forming a loop with the strap,
- "effective by friction-locking"—the closing mechanism of the buckles work by a movable lever and clamping it on a strap so that the strap is pressed together and thus locked at a certain position; the clamping force must be high enough to avoid the strap slipping out of the buckle during regular use of the sandals,
- "slidable with open clamping lever"—in this configuration the buckle is not locked to the strap an can be moved along the straps,
- "single-variety"—means, that in one component, which is not designed to be disassembled, there is no material mix; the component is made from the exact same raw material, which can be recycled pure of a sort,
- "sub-component"—one part of a component when composed from several parts,
- "cushioning property"—the characteristic of the sole material to allow a damping effect and thus allow a soft and comfortable treading with the foot,
- "foamed structure"—shoe soles made of plastic often consist of foam parts; to create a foam during the manufacturing process, there is a blowing agent creating a structure with many gas or air bubbles enclosed in the material when heat is applied in the production process,
- "constructional elasticity by a 3D structure"—the geometry of the sole could be designed in a manner that it can be compressed to a desired measure to create a damping effect; a typical structure would be a three-dimensional grid or lattice,
- "reinforces the apertures (5) subjected to tensile stress"—when lifting the foot in the sandal, there will be a tensile (pulling) force transmitted from the straps to the connecting points of the sole; to withstand this tensile force, the apertures must be designed strong enough,
- "formed from the same polymer"—polymer is the technical term when talking about the raw material structure of plastics; when creating several plastic components from the same polymer, usually the same recycling processes can be used,
- "adhesive"—an adhesive is any substance that is capable of holding materials together in a functional manner by surface attachment that resists separation,
- "biodegradable"—the term biodegradable means that a material is able to decay naturally (breaks down without any special scientific treatment) and in a way that is not harmful, e. i. made of biodegradable resins
- "compostable"—describes a material that can disintegrate into non-toxic, natural elements; it also does so at a rate consistent with similar organic materials; compostable products require microorganisms, humidity, and heat to yield a finished compost product ($CO_2$, water, inorganic compounds, and biomass).

The goal of the invention is to provide a user friendly technical solution to make it possible to assemble and disassemble the sandals, so the users can separately exchange and/or repair every single component such as soles, straps and buckles, and so the provider can guarantee a reasonable recycling process of all components, for which the separation in single-variety materials in a simple way is elementary. The present invention is based on the objective to achieve an easily operated and non-destructive replacement of the individual components sole and straps and buckles. It presents a technical solution to connect the upper, in the form of straps, to the sole via specific detachable fastening elements such as buckles, which are operating on the principle of clamping, which creates a friction-locking connection. The invention thereby constructively dispenses of seams, welding, gluing or other connections that cannot be separated without destruction. It can be understood as a usability-friendly and manufacturing-friendly alternative to the prior art enriched by the above cited patent application US 2015/0 237 950 A1 or a complementation and improvement to the further cited inventions DE 20-2015/008 872 U1 or US 2008/0 168 682 A1 or US 2014/0 230 286 A1. The present invention is characterized by a novel and inventive combination of two principles which are considered prior art if used independently—firstly the principle to connect the upper of sandals with a sole by guiding them through apertures in the sole and either anchoring it or, in case of an upper made of straps, attaching the end of the strap after building a loop to the strap again with; and secondly the principle of a detachable strap fastening advice operating on a clamping mechanism which can be manually locked and released. The combination of these two independent solutions creates an innovative stand-alone solution for connecting the straps with the sole of sandals and thus differs from the existing prior art solutions.

As an improvement over US 2015/0 237 950 A1 regarding easy producibility, the strap which can be used for the present invention can be standard webbing manufactured by the meter and doesn't need a special textile construction to form the apertures along the length of the strap.

The above mentioned objectives are achieved with the present invention. A sandal having detachable strap fastening, comprising a sole, at least one strap and as fastening element at least one cam buckle and/or at least one anchor buckle. The sandal is characterized in that it is modularly constructed and can be easily assembled and disassembled, wherein the sole and the at least one strap are connected to each other by guiding the at least one strap through apertures provided in the sole, and that the two ends of the at least one strap are either fastened to the strap by means of at least one of the cam buckles so as to form a loop or are anchored to one of the aperture by means of at least one of the anchor buckles, in which the at least one cam buckles and/or the at least one anchor buckles function by friction-locking and can be opened manually after closing and are detachable from the strap.

In other words, the strap ends are passed through the apertures integrated in the sole and are either anchored to the aperture by fastening an anchor buckle to the strap end or are turned over and fastened to the strap by means of a cam buckle consisting of one or two clamping levers.

The basic functionality of the sandal makes as a minimum one strap necessary, but it could also be composed by two or more separate straps. The listing of several embodiments shows that a sandal could be composed by only using anchor buckles, or only using cam buckles, or using a combination of both buckle types.

It is possible to use existing clamping buckle principles, such as closing clips, which may form an anchorage when attached to the strap end, and which can be opened manually to detach from the strap end for disassembly. The cam buckles are designed such that the clamping levers can be manually opened again after manually locking and connecting to the straps and can thus be detached from the strap for disassembly. One or more of the buckles may optionally be designed such that they both fix the strap end and allow the strap to be tightened and loosened for ideal adaptation to any foot shape, for example, conventional cam buckles used for belts, consisting of two clamping levers, in which one strap end is attached and the other strap end is guided through the belt buckle and can be variably locked with a second clamping lever in different positions, for example for flexible circumferential adjustment. The use of these buckle types operating on clamping principles, in particular friction-locking, makes it possible to form a loop or anchorage without the strap having a material bond, in particular a seam, a welding, a gluing or a riveted joint.

Advantageous variations by design of the sole for the described invention are proposed as follows. The sole as part of the invention has three main functions—to create a pleasant wearing comfort, to protect the foot from injuries caused by the ground and to form the connecting points to the detachable straps. The important features for a pleasant wearing comfort are on the one hand a anatomically shaped footbed to create a secure fit and on the other hand cushioning properties to create a soft tread. A conventional method to create cushioning properties is the use of an elastic material, which is foamed in the forming process, such as injection molding, or pouring, or compression molding.

A possible implementation of a constructional elasticity could be realized by a 3D structure or 3D geometry, for example with a 3D-printed lattice structure. The protecting functions can be realized as follows. When using a sole made of one sub-component, it should provide the necessary footbed and also take over the function of an outsole, thus must be thick enough and have sufficient puncture resistance to provide the necessary protection against injuries originating from ground contact. When using two sub-components, a harder sub-component, and thus stronger part, can serve the function to build out the apertures for example at the outer edge of the sole for connecting the straps, which must withstand a higher tensile stress created by the foot pulling on the straps when walking and lifting off the heel.

Alternatively a softer sub-component, built out as a midsole, can solely take over the function of the footbed and the cushioning properties, and thus a pleasant wearing comfort, and an outsole, made of a harder sub-component can take over the function of protecting the foot against injuries originating from ground contact. Therefore a stronger material with higher puncture resistance and higher abrasion resistance can be chosen for the outsole. The outsole made of the harder sub-component, could in this configuration also be designed in that way to create reinforcement to build out the apertures. The apertures may be designed in various possibilities, such as eyes, eyelets, slits or loops, depending on the general sole design.

In the sandal according to the invention, all separate components, right and left sole, straps and buckles are manufacturable in single-variety material. The exact material choice is not relevant for the invention, since there will be numerous material options suitable. The fact that every separate component can be directly sent to the matching material recycling stream, lowers the complexity of the recycling process. The buckles could be made of the exact same material without having a mix of different materials, for example all buckles made exclusively of POM (Polyoxymethylene, also known as acetal), or exclusively of Nylon, or exclusively of TPU (thermoplastic urethane), or exclusively of Steel, or exclusively of Aluminum.

The strap could be made of textile material via weaving, or braiding, or knitting, or even a non-woven construction, all using exclusively one single material in its construction, for example Polyester fibers, or Nylon fibers, or several biodegradable materials such as for example Cotton fibers (compostable), or Hemp fibers (compostable), or Flax fibers (compostable), or Wool fibers (compostable), or many other options. Compostable materials do not need to be deposed in a landfill, burned or recycled, they can be treated together with other organic waste like kitchen waste, and would even decompose by natural processes if lost in the landscape.

The strap could also be made exclusively of leather or exclusively of a solid flexible plastic material such as for example Silicone. The sole could be made of two sub-components made of the same polymer each such as, for example, TPU in both sub-components, or EVA (ethylene-vinyl acetate), in both sub-components, or PU in both sub-components. The sole can be manufactured in various methods according to prior art, such as injection molding, or pouring, or compression molding. When using two different sub-components, the two parts can be connected by gluing or even produced in one process via two components (2K) molding or two-shot molding. When gluing the two sub-components, there is the possibility to use reversible adhesives, so they can be separated before the recycling process by heat treatment. Alternatively the two parts can be separated by a mechanical process. Additionally, it is also an option to use biodegradable or even compostable material to create the sole. Until now it would already be possible to use fully biodegradable material, like for example algae-based polyurethane, for the midsole and it is assumed that materials research in the near future will also develop biodegradable plastics with the required physical properties so it can be used for the outsoles including the apertures.

To join the two sub-components of the sole which might be made of biodegradable material, also a biodegradable adhesive, such as for example water based biodegradable hot-melt glue or even natural latex or rubber based glue, will be necessary to create a fully biodegradable sole.

In this respect of permanent direct user contact and the objective of user friendliness, specific requirements exist for the straps, the design of the apertures and the construction of the anchor buckles or cam buckles. The direct skin contact with the strap and the anchor buckle or cam buckle results in requirements for the strap material regarding strap surface, stiffness, fastness, skin compatibility and cleaning, as well as for the construction and material of the anchor buckle or cam buckle regarding material, surface, edge quality and safety against pinching. The design of the apertures as a link between the strap and the sole must have sufficient strength to withstand tensile stress as described above on the one hand, and on the other hand allow easy threading through when installing or replacing the strap.

The invention advantageously achieves that the individual assembly steps are reduced to a minimum and no additional machines or devices are required for the assembly. The sandal according to the invention can therefore be disassembled at any time and recomposed in a modular fashion. The user can thus compose his sandals himself and replace all the components straps, soles and buckles as he wishes. This could eliminate the assembly step in the manufacturing process. This would allow saving assembling costs and thus making it more convenient to produce at a geographically close location without high manufacturing costs which would result in a high product price due to high labor costs caused by manual assembly. At the end of the product use cycle, it is possible to recycle the sandal in its individual components without prior laborious disassembly into these components being necessary.

BRIEF DESCRIPTION OF THE DRAWINGS

Possible embodiment examples of the invention are explained using FIGS. 1, 2, 3, 4, 5 and 6. In the figures.

DETAILED DESCRIPTION OF THE PREFERRED EMBODIMENTS

Figure 1:
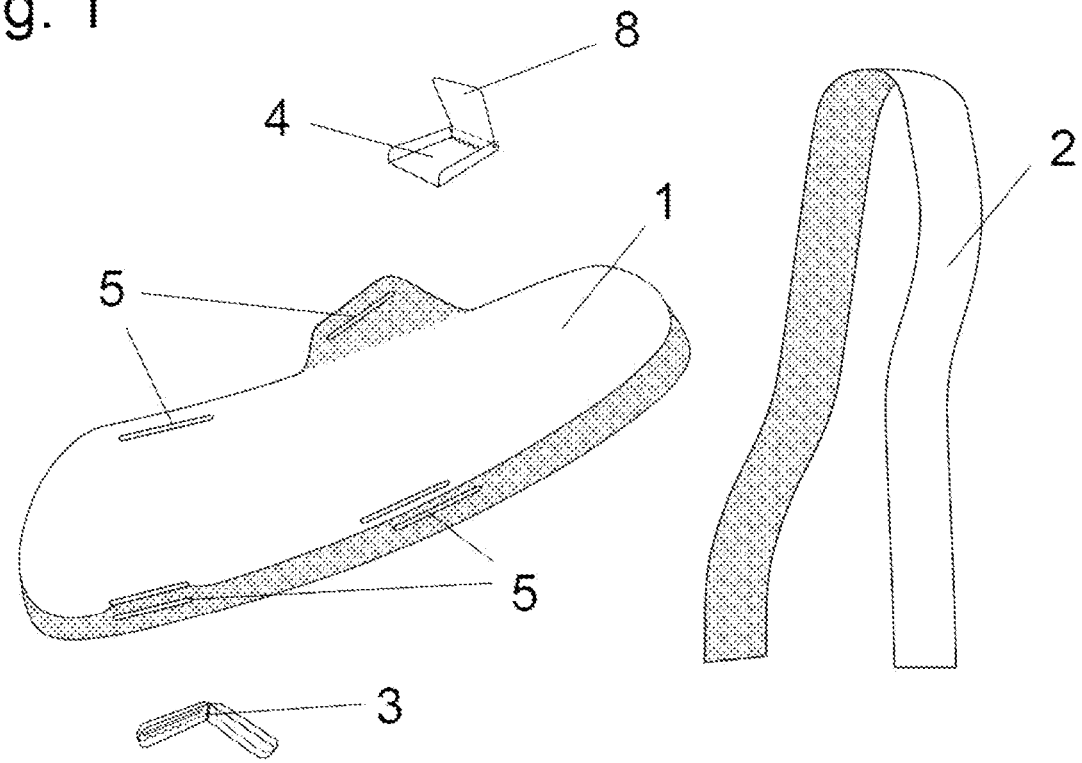
FIG. 1: is a schematic perspective view of an embodiment of all individual components of the sandal.

FIG. 1 schematically shows an embodiment example of the sandal in which it is disassembled into its individual components, i.e. is available as a kit. Said kit comprises a sole 1 with the integrated apertures 5, a strap 2, a simple anchor buckle 3 and a cam buckle 4 with an open long clamping lever 8

Figure 2:
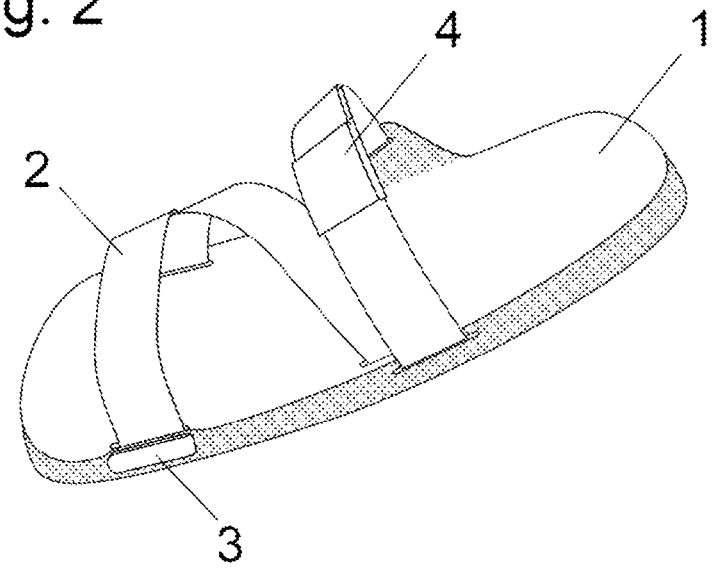
FIG. 2: is a schematic perspective view of an embodiment of a fully assembled sandal.

FIG. 2 shows the same embodiment example in the assembled state. Here the strap 2 is guided through all apertures 5 and anchored at one end with the simple anchor buckle 3 to one of the apertures 5 and with the other end, after passing through another one of the apertures 5, turned over and fastened to the strap 2 with the cam buckle 4.

Figure 3:
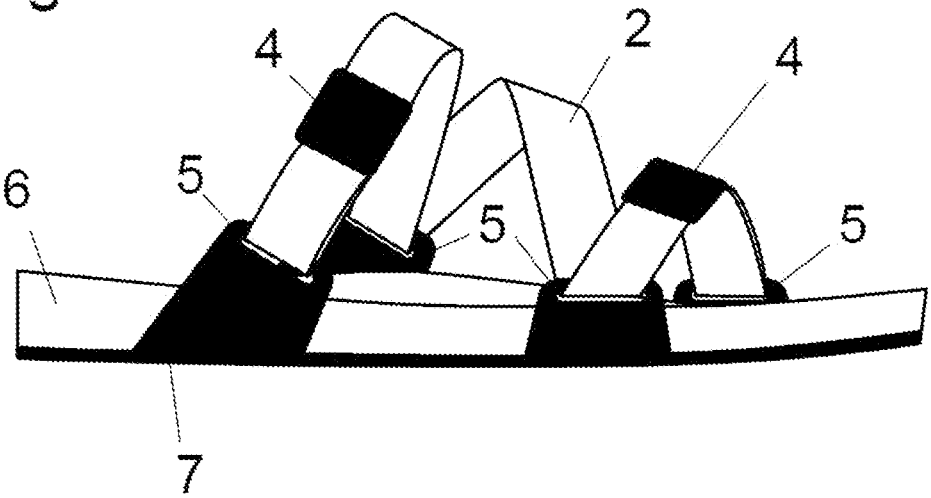
FIG. 3: is a side view of a fully assembled sandal in an embodiment with a sole made of two sub-components and the strap end fixation with one slidable cam buckle each.

FIG. 3 shows a fully assembled embodiment example where the sole 1 consists of a softer sub-component 6 for cushioning and shaping the footbed and a harder sub-component 7, both forming the apertures 5 and shaping the outsole to provide abrasion resistance and puncture resistance. For each sandal, right and left, there is only one strap 2 used each. Both ends of the strap 2 are guided through apertures 5 and are folded back to be attached by a slidable cam buckle 4 each. In this embodiment there are two cam buckles 4 used for one of the soles 1, right or left. The cam buckles 4 are designed with two clamping levers, while in each case the strap end is fastened to one of the clamping levers and, after building the loop through the aperture 5, the strap 2 is guided under the opened second clamping lever and afterwards securely locked at a designated position. In this embodiment it is possible to adjust the strap fastening to the size and shape of the user's foot via the two slidable cam buckles 4.

Figure 4:
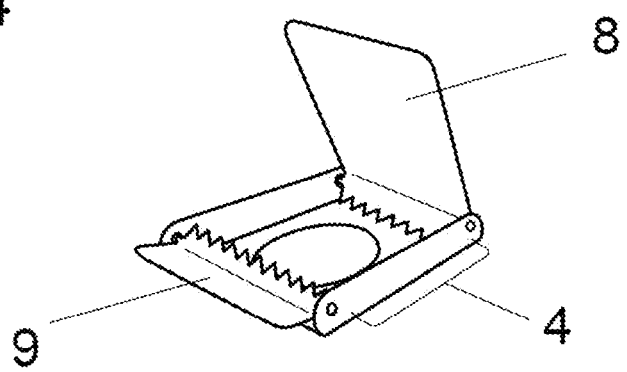
FIG. 4: is a schematic perspective view of a slidable cam buckle with two open clamping levers.

FIG. 4 shows a slidable cam buckle 4 with two clamping levers 8 and 9. Both clamping levers 8 and 9 are in an open state. The cam buckle 4 is ready to be used to compose a sandal or in case of its end of use it is ready to be recycled, consisting of three sub-components all made of the same material and thus building a buckle of single-variety.

Figure 5:
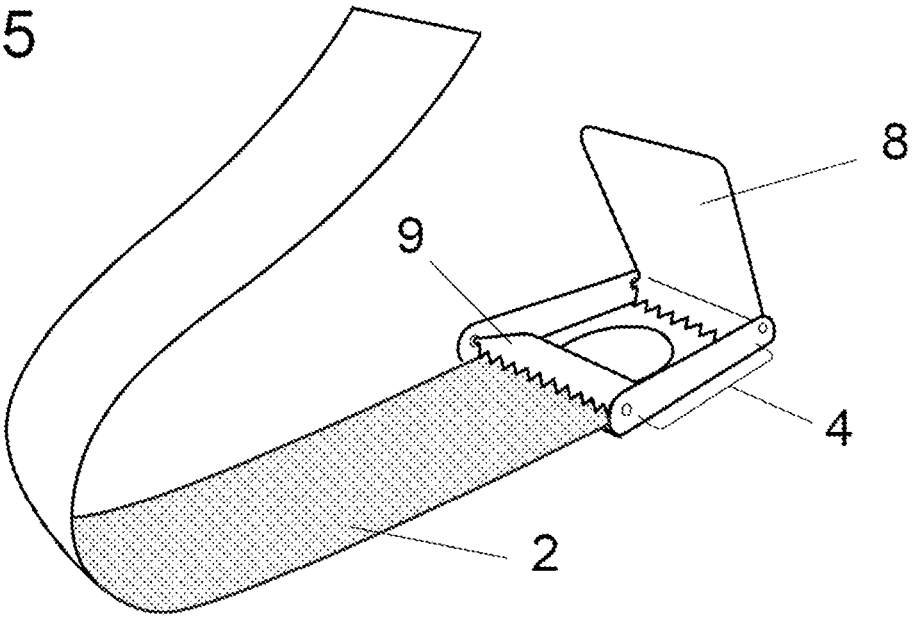
FIG. 5: is a schematic perspective view of a slidable cam buckle with an open long clamping lever and a strap end affixed by the short clamping lever.

FIG. 5 shows the same slidable cam buckle 4 as shown in FIG. 4 additionally having a strap 2 attached to the short clamping lever 9, which is closed. The long clamping lever 8 is in an open state.

Figure 6:
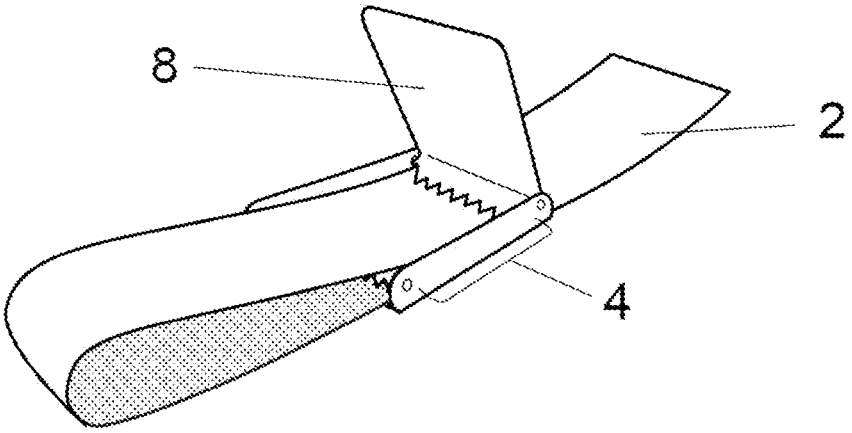
FIG. 6: is a schematic perspective view of a slidable cam buckle with a strap end affixed by the short clamping lever and the strap building a loop and being guided through under the open long clamping lever.

FIG. 6 shows the same slidable cam buckle 4 as shown in FIG. 5 with the one end of the strap 2 affixed by the short clamping lever 9 and additionally guided under the open long clamping lever 8. This shows the attaching principle by forming a loop which must be guided through one of the apertures 5 in the sole 1 to attach the strap 2 to the sole 1. In this configuration the cam buckle 4 can be slid on the strap 2 and the loop can be reduced or enlarged. When adjusted to the right fit, the long clamping lever 8 will be closed by pushing it down and thus locking the strap 2 by friction-locking at the desired position.

LIST OF REFERENCE NUMERALS

1 sole
2 strap
3 anchor buckle
4 cam buckle
5 apertures
6 softer sub-component (of the sole)
7 harder sub-component (of the sole)
8 long clamping lever (of the cam buckle)
9 short clamping lever (of the cam buckle)

The invention claimed is:

1. A sandal having detachable strap fastening, comprising a sole (1), at least one strap (2), and according to a first embodiment at least two cam buckles (4), in which the sandal is modularly constructed and can be easily assembled and disassembled, in which the sole (1) and the at least one strap (2) are connected to each other by guiding the at least one strap (2) through apertures (5) in the sole (1), and ends of the at least one strap (2), are secured to the strap (2) by means of the at least two cam buckles (4) so as to form a loop, characterized in that the at least two cam buckles (4) function by friction-locking and can be opened manually after closing and are detachable from the at least one strap (2).

2. The sandal according to claim 1, wherein the at least two cam buckles (4) are configured to secure a turned-over end of the at least one strap (2) to the strap (2) so as to form a loop around one of the aperture (5) and thereby fix the strap (2) to the sole (1).

3. The sandal according to claim 2, wherein the at least two cam buckles (4) are configured to be slidable with opened long clamping lever (8) and thus allows the shortening and lengthening of the used strap length in order to allow a flexible adaptation to the foot.

4. The sandal according to claim 1, wherein the apertures (5) integrated in the sole (1) are designed as an eyelet, slit, incision, hole or formed loop.

5. The sandal according to claim 1, wherein the sole (1) consists of only one component and a cushioning property is created by a constructional elasticity of a 3D structure.

6. The sandal according to claim 1, wherein the sole (1) is made of two sub-components connected to each other, wherein a softer sub-component (6) both acts as the cushion and forms the footbed, and a harder sub-component (7) at the outer edge of the sole (1) forms and/or reinforces the apertures (5) subjected to tensile stress.

7. The sandal according to claim 6, wherein the softer sole sub-component (6) realizes its cushioning function via a foamed structure.

8. The sandal according to claim 6, wherein the sole (1) is produced in a 2K-injection molding process, wherein both sub-components (6, 7) are formed from the same polymer and can thus also be recycled as a whole.

9. The sandal according to claim 6, wherein the sole (1) is made of two sub-components (6, 7) joined together by an adhesive, wherein it is provided that both sub-components can be separated from each other by a simple process and recycled individually.

10. The sandal according to claim 9, wherein at least one of the sub-components (6, 7) consists of a biodegradable polymer.

11. The sandal according to claim 6, wherein the harder sub-component (7), in addition to the formation of the apertures (5), is additionally formed at least partially as an undersole and thus additionally ensures abrasion resistance and puncture resistance.

12. The sandal according to claim 1, wherein the at least one strap (2) is made of biodegradable single-variety raw material and is compostable.

13. The sandal according to claim 1, wherein the at least two cam buckles (4) are made of the same single-variety material.

14. A kit for a sandal according to claim 1, wherein the kit comprises a sole (1), at least one strap (2), and according to a first embodiment at least two cam buckles (4), which can be assembled and disassembled without tools, wherein two ends of the at least one strap (2), which form two strap ends, to be fastened to the strap (2) by means of at least one of the cam buckles (4) so as to form a loop, characterized in that the two cam buckles (4) function by friction-locking and can be opened manually after closing and are detachable from the at least one strap (2).

* * * * *